United States Patent [19]

Kulpa et al.

[11] 4,406,448

[45] Sep. 27, 1983

[54] PAPER CASSETTE

[75] Inventors: Walter J. Kulpa, Norwalk; Leo Wologodzew, Huntington, both of Conn.

[73] Assignee: Pitney Bowes Inc., Stamford, Conn.

[21] Appl. No.: 286,486

[22] Filed: Jul. 24, 1981

[51] Int. Cl.[3] ..... B65H 1/12

[52] U.S. Cl. ..... 271/160; 221/227; 271/127; 271/167; 271/170

[58] Field of Search ..... 271/127, 160, 162, 164, 271/167, 169, 170, 171; 221/227

[56] References Cited

U.S. PATENT DOCUMENTS

| | | | |
|---|---|---|---|
| 3,919,972 | 11/1975 | Komori et al. | 271/127 X |
| 4,017,181 | 4/1977 | Komaba et al. | 271/162 X |
| 4,285,510 | 8/1981 | Kanno et al. | 271/127 |
| 4,343,461 | 8/1982 | Tomimori et al. | 271/171 X |

*Primary Examiner*—Bruce H. Stoner, Jr.

*Attorney, Agent, or Firm*—Lawrence E. Sklar; William D. Soltow, Jr.; Albert W. Scribner

[57] ABSTRACT

A removable paper cassette for feeding different lengths of cut paper sheets seriatim to a machine operatively associated with the cassette. The cassette includes a chutelike base having a bottom panel, and a pair of sidewalls contiguous with the front wall and extending only along a portion of the bottom panel. The cassette further includes an upwardly biased paper elevating plate pivotably secured at its rearward section to the base, the plate having a pair of detents situated in the forward section thereof adjacent the sidewalls, and a cassette cover pivotably secured to the sidewalls of the base. The cover includes a pair of inwardly projecting camming fingers integral therewith, one on each side of the forward section thereof. The detents engage the fingers when the cover is raised to the open position whereby the cover is held in the open position and the elevating pate is maintained in a depressed position ready for paper loading.

4 Claims, 4 Drawing Figures

PAPER CASSETTE

BACKGROUND OF THE INVENTION

The instant invention relates to a cassette for feeding paper sheets to be fed seriatim therefrom, and more particularly to such a cassette which allows the use of various lengths of paper in an electrophotocopying machine without requiring the changing of cassettes.

The transfer paper for transfer type copying devices, and the photosensitive paper used in electrofax systems, as well as the printing paper used in simple printers are considered as cut sheets. It is common practice to automatically feed such sheets by positioning them in a cassette and then loading the cassette into the unit. Some of the prior art cassettes include free floating corner separators which exert a downward pressure on the stack of sheets being fed equal only to their own weight, and a paper elevating plate which can be spring biased upwardly against a feed roller so that the top sheet of the stack of sheets is always fed from the same height. An example of the foregoing type of cassette can be found in U.S. Pat. No. 3,919,972, issued Nov. 18, 1975.

With prior art cassettes, whenever it is desired to provide a machine such as a photocopier with more than one size paper, a number of cassettes corresponding to the number of different sized sheets employed must be used. The instant invention overcomes this problem by providing a cassette which includes the latest advance of free floating corner separators and an upwardly biased paper elevating plate and which can accommodate many different sizes of paper. The advantage of the instant invention is that when a machine operator desires to change the size of the paper, it is only necessary to raise the cover of the cassette, remove the paper already in the cassette, and insert the desired paper into the cassette; there is no need for the operator to move any other levers or parts of the cassette independent from the cassette cover, as the upwardly biased paper elevating plate is automatically depressed by the cover of the cassette being raised.

SUMMARY OF THE INVENTION

Accordingly, the instant invention provides a removable paper cassette for feeding different lengths of cut paper sheets seriatim to a machine operatively associated with said cassette. The cassette comprises a chute-like base having a bottom panel, a front wall projecting upwardly from the bottom panel, and a pair of sidewalls contiguous with said front wall and extending only along a portion of said bottom panel. The cassette also includes an upwardly biased paper elevating plate pivotably secured at its rearward section to said base, said plate having a pair of detents situated in the forward section thereof adjacent the sidewalls, and a cassette cover pivotably secured to the sidewalls of the base. The cover includes a pair of inwardly projecting camming fingers integral therewith, one on each side of the forward section thereof. The detents engage the fingers when the cover is raised to the open position whereby the cover is held in the open position and the elevating plate is maintained in a depressed position ready for paper loading.

DETAILED DESCRIPTION

Figure 1:
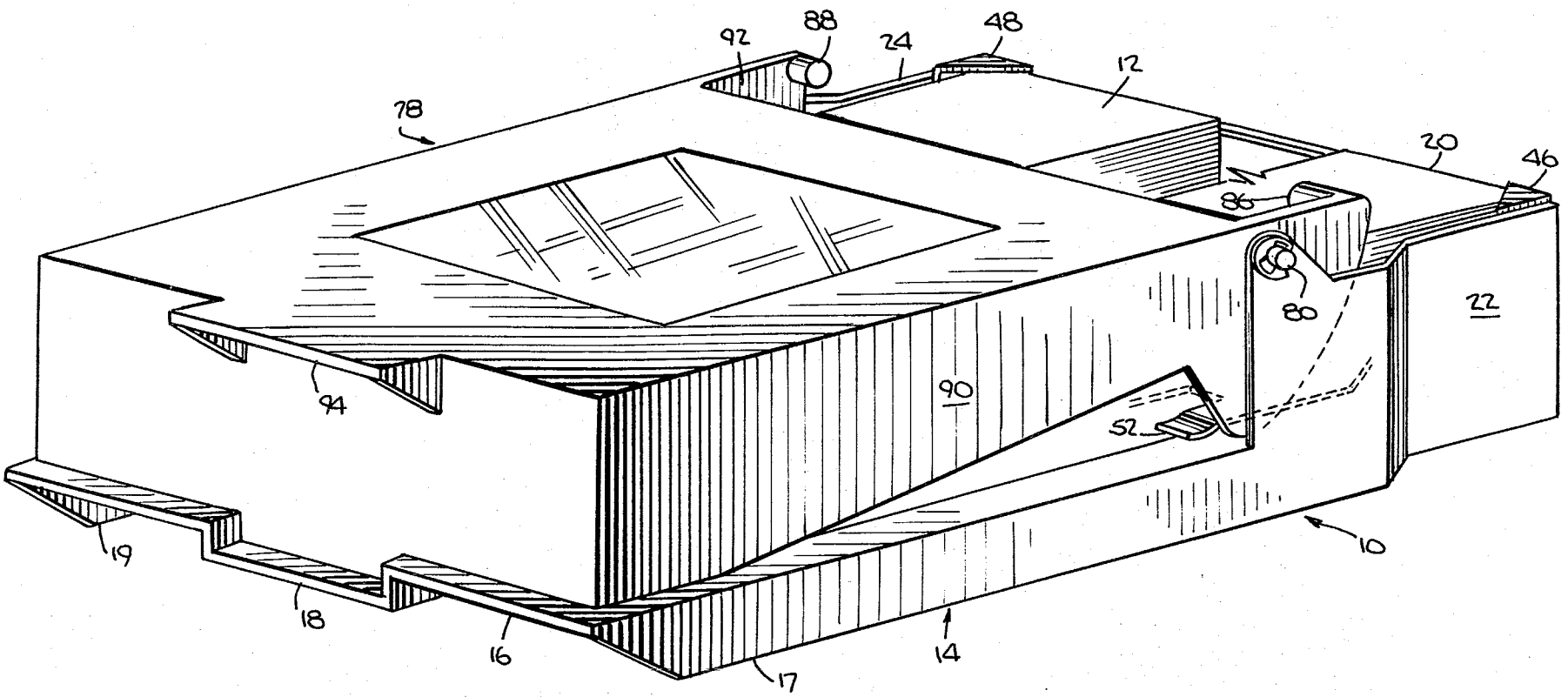
FIG. 1 is a perspective view of a paper cassette according to the instant invention.
Figure 2:
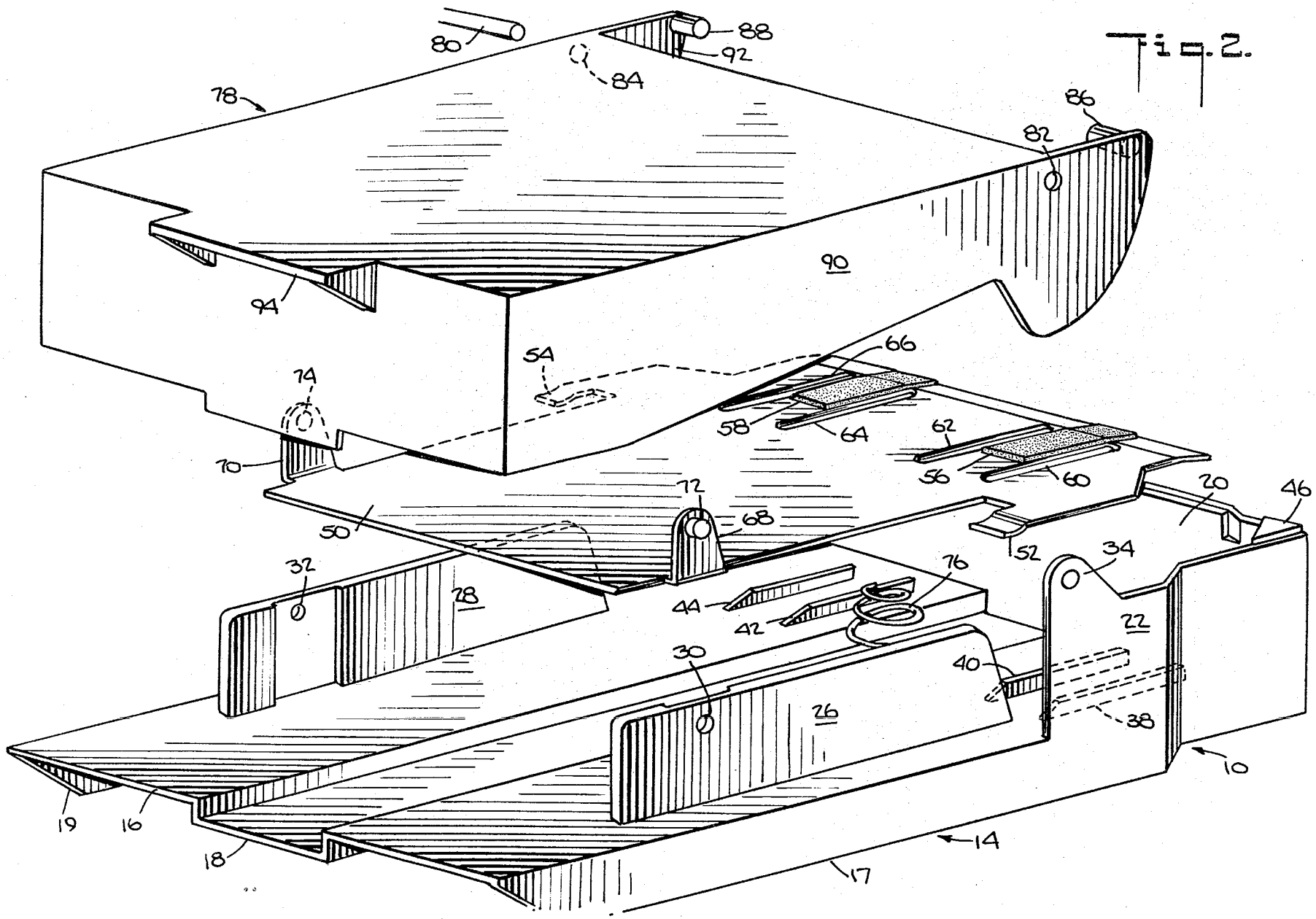
FIG. 2 is an exploded perspective view of the cassette seen in FIG. 1.
Figure 3:
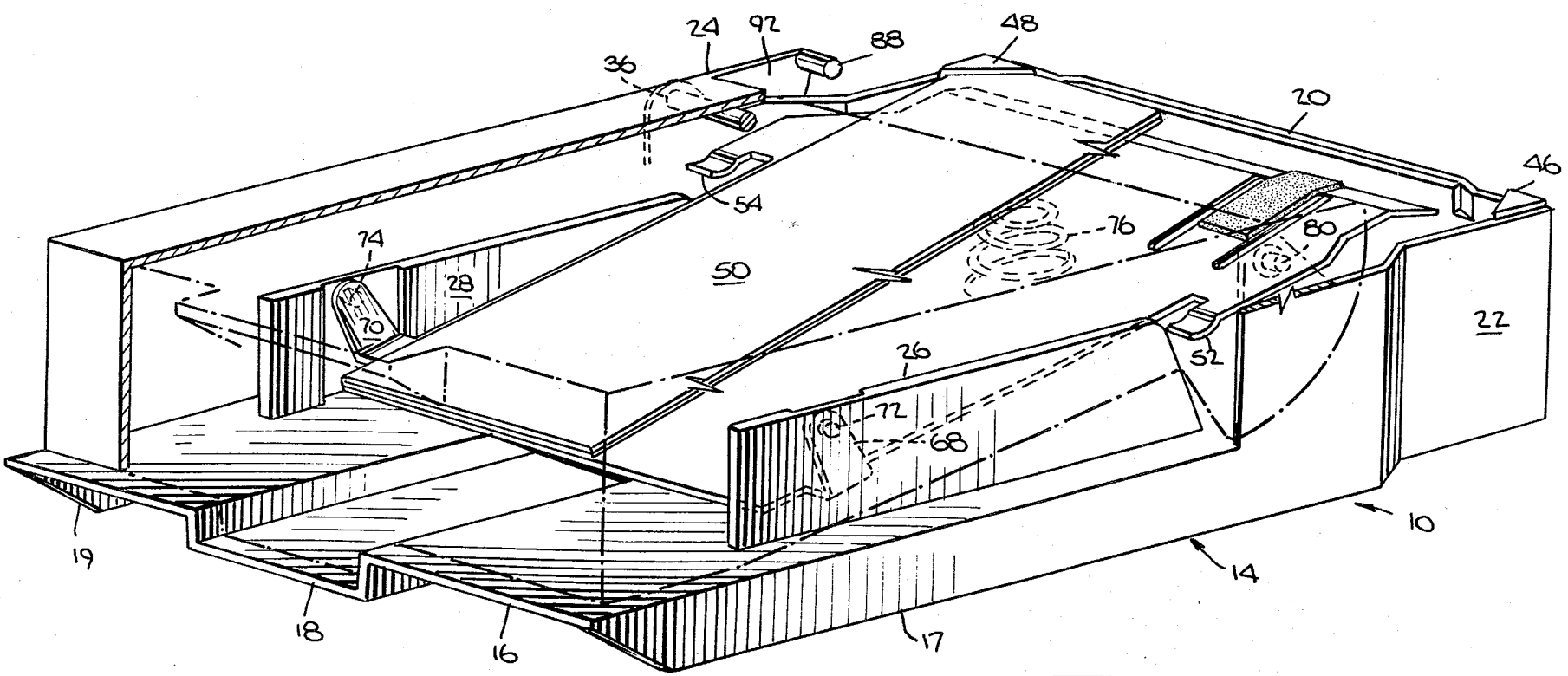
FIG. 3 is similar to FIG. 1 except that it is broken away to show the interior elements of the cassette, and the paper elevating plate is spring biased upwardly.

In describing the preferred embodiment of the instant invention, reference is made to the drawings, wherein there is seen a removable paper cassette generally designated 10 for feeding different sizes of cut paper sheets 12 (see FIG. 4) seriatim to a machine such as an electrophotocopier (not shown) operatively associated with the cassette 10. The cassette 10 includes a chute-like base 14 having a bottom panel 16 which includes therein a longitudinally extending rectangular slot 18 and skirts 17 and 19 depending therefrom. The cassette 10 further includes a front wall 20 projecting upwardly from the bottom panel 16, and a pair of sidewalls 22 and 24 contiguous with the front wall 20 and extending about ⅓ of the way from the front to the back of the bottom panel 16, where the sidewalls 22 and 24 merge with the skirts 17 and 19 respectively of the bottom panel 16. Situated on either side of the bottom panel 16 and projecting upwardly therefrom are a pair of paper guides 26 and 28 having apertures 30 and 32 therein respectively (see FIG. 2). The sidewalls 22 and 24 also include a pair of openings 34 and 36 respectively in the rearward portions thereof. The bottom panel 16 further includes two pairs of ramp-like ribs 38 and 40 and 42 and 44 situated in the forward section thereof (see FIG. 2). Located at the juncture of the front wall 20 and the sidewalls 22 and 24 are conventional free floating corner separators 46 and 48 for facilitating a buckle feed of the top sheet of the cut paper sheets 12 being stored in the cassette 10 by a feed roller (not shown) associated therewith.

The cassette 10 further includes an upwardly biased paper elevating plate 50 having a pair of detents 52 and 54 situated in the forward section thereof adjacent the sidewalls 22 and 24. Also located in the forward section of the elevating plate 50 are a pair of last-sheet retaining pads 56 and 58 (see FIG. 2), which are flanked by a pair of slots 60 and 62, and 64 and 66 respectively which permit the ribs 38, 40, 42 and 44 to project through the elevating plate 50 and defeat the function of the pads 56 and 58 when the cover 78 is raised. The rearward portion of the elevating plate 50 includes a pair of flanges 68 and 70 having protuberances 72 and 74 respectively for pivotal engagement with the apertures 30 and 32 respectively. The elevating plate 50 is biased upwardly by a coil spring 76 which is secured to the bottom panel 16. The pivot location and design of the spring 76 should produce an approximately constant upward force as the sheets of paper 12 are removed.

Figure 4:
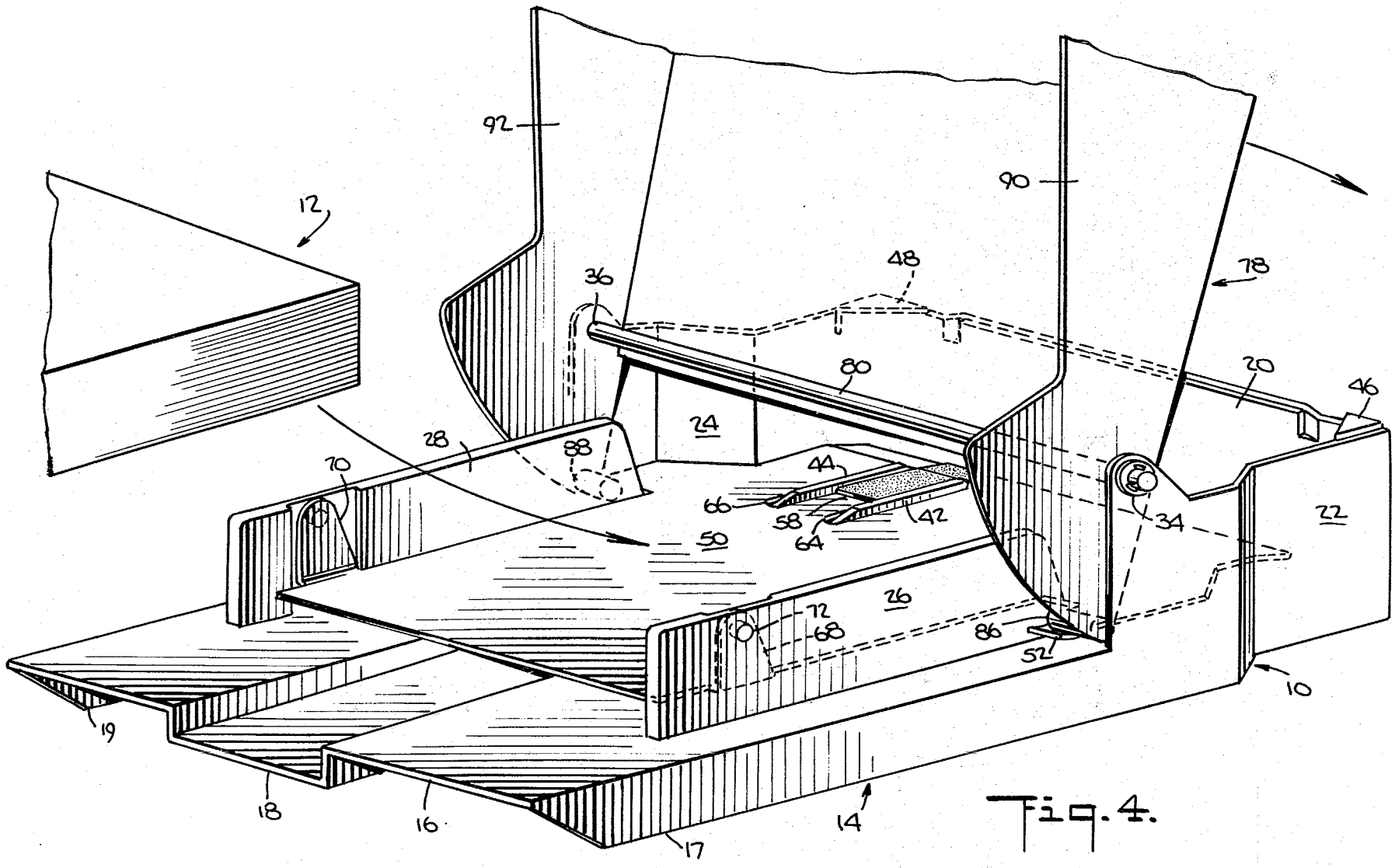
FIG. 4 is a perspective view of the cassette seen in FIG. 1 with the cover in the open position.

A cover 78 is provided for the cassette 10 which is pivotably secured to the sidewalls 22 and 24 by means of a shaft 80 extending through apertures 82 and 84 (see FIG. 2) in the cover 78 and the openings 34 and 36 in the sidewalls 22 and 24 respectively. The cover 78 includes a pair of camming fingers 86 and 88 projecting inwardly from the sides 90 and 92 respectively of the cassette cover 78. The rearward portion of the cover 78 includes a handle 94 for raising and lowering the cover 78. When the cover 78 is raised to the open position as seen in FIG. 4, the camming fingers 86 and 88 come to rest in the detents 52 and 54 respectively.

In operation, the slot 18 facilitates the loading or changing of paper in the cassette 10. Loading of paper is enabled by the raising of the cover 78 so that the fingers 86 and 88 come to rest in the detents 52 and 54 respectively. The detents serve to maintain the cover 78 in the raised position. As the fingers 86 and 88 are being moved toward engagement with the detents 52 and 54, they are cammingly engaging the paper elevating plate 50 to overcome the bias effect of the spring 76 and urge the plate 50 downward. With the plate 50 in the downward position and the cover 78 up as seen in FIG. 4, in order to change paper it is only necessary to remove the paper already in the cassette 10 and to insert the desired paper, or place the desired paper size on top of that already in the cassette. There is no need for the operator to move any other levers or parts of the cassette independent from the cassette cover 78, as the upwardly biased elevating plate 50 is automatically depressed by the fingers 86 and 88.

If it is desired to employ a cassette 10 which is capable of storing sheets of paper of varying widths, it is only necessary to change the fixed paper guides 26 and 28 to slidably adjustable paper guides capable of accommodating various width paper sheets. The coil spring 76, although shown as being secured to the bottom panel 16, may be secured to the machine with which the cassette 10 is operatively associated. Also, it is not necessary that a pair of last-sheet retaining pads 56 and 58 be used, as a single last-sheet retaining pad may well suffice.

While the instant invention has been described as carried in specific embodiments thereof, it is not desired to be limited thereby, and it is intended to cover the invention broadly within the scope of the appended claims.

What is claimed is:

1. A paper cassette for feeding different lengths of cut paper sheets seriatim to a machine operatively associated with said cassette, comprising:

a chute-like base having a bottom panel, a front wall projecting upwardly from the bottom panel, and a pair of sidewalls contiguous with said front wall and extending only along a portion of said bottom panel, said bottom panel including at least one pair of ramp-like ribs in the forward section thereof;

an upwardly biased paper elevating plate pivotably secured at its rearward section to said base, said plate having a pair of detents situated in the forward section thereof adjacent said sidewalls and at least one last-sheet retaining pad in the forward section thereof flanked by a pair of slots; and a cassette cover pivotably secured to said sidewalls of said base, said cover having a pair of inwardly projecting camming fingers integral therewith one on each side of the forward section thereof, wherein when said cover is raised to the open position said detents engage said fingers and depress said elevating plate so that said ribs project through said slots to thereby defeat the function of the last-sheet retaining pad, whereby said cover is held in said open position and said elevating plate is maintained in a depressed position ready for paper loading.

2. The cassette according to claim 1, wherein the bottom panel includes a longitudinally extending rectangular slot for facilitating paper changes.

3. The cassette according to claim 1, further including a pair of paper guides projecting upwardly from either side of the bottom panel.

4. The cassette according to claim 1, further including a pair of free-floating corner separators located at the juncture of the front wall and sidewalls.

* * * * *